United States Patent [19]

Cotton, Jr. et al.

[11] 4,107,891

[45] Aug. 22, 1978

[54] MODULAR BUILDING PANEL WITH HEAT NONCONDUCTING MEANS

[75] Inventors: Worth Cotton, Jr.; A. Reese Hunter, both of Greensboro, N.C.

[73] Assignee: Industrial Air, Inc., Greensboro, N.C.

[21] Appl. No.: 813,872

[22] Filed: Jul. 8, 1977

[51] Int. Cl.[2] ..... E04B 2/28; E04B 2/88; E04C 2/08

[52] U.S. Cl. ..... 52/394; 52/404; 52/593

[58] Field of Search ..... 49/DIG. 2; 52/592, 574, 52/403, 394, 393, 404, 309.9, 309.11, 364, 376, 595

[56] References Cited

U.S. PATENT DOCUMENTS

| | | | |
|---|---|---|---|
| 1,706,769 | 3/1929 | Buck | 52/592 |
| 3,121,264 | 2/1964 | Hammar | 52/376 |
| 3,491,499 | 1/1970 | Dyer | 52/421 |
| 3,564,800 | 2/1971 | Armitage | 52/394 |

FOREIGN PATENT DOCUMENTS

| | | | |
|---|---|---|---|
| 704,982 | 3/1965 | Canada | 52/593 |
| 2,037,812 | 3/1972 | Fed. Rep. of Germany | 52/309.9 |

*Primary Examiner*—John E. Murtagh

[57] ABSTRACT

A pair of identically formed facing sheets are joined along opposite side edges and include a fiberglass core therebetween. Each of the facing sheets includes a central web section, a side wall extending inwardly from each side edge thereof, a first flange extending inwardly from the free edge of one of the side walls and a second flange extending outwardly from the free edge of the other of said side walls. Both flanges are substantially parallel to the central web section. The pair of facing sheets are positioned opposite each other and with the first flange of each sheet adjacent the second flange of the opposite sheet. A support member is inserted in the space formed by the inwardly extending flange, adjoining side wall, and opposite section of the central web. Finally, the flanges are joined with fasteners, with a strip of heat non-conducting, material inserted between the adjoining flanges of the facing sheets when assembled to minimize transfer of heat and/or prevent flow of current from one facing sheet to the other.

In joining one of the aforementioned building panels to an adjacent panel, the panels are positioned together with a side edge of one in overlapped relationship with the corresponding edge of the other. A plastic nonadherent force absorbing member or rod is inserted between the adjoining side walls of the adjacent panels along the inside and outside juxtaposed surfaces. The force absorbing member is then covered with a silicon base, cementitious material which forms an elastomeric joint, uniting the two panels together. The elastomeric joint allows expansion and contraction due to temperature change without shearing of the silicon cementitious material.

6 Claims, 2 Drawing Figures

MODULAR BUILDING PANEL WITH HEAT NONCONDUCTING MEANS

BACKGROUND OF THE INVENTION

In recent years, the use of prefabricated, modular building panels which are factory formed then taken to the building site and assembled has become increasingly in demand. Such building panels generally take the form of a pair of spaced walls or skins having inserted therebetween some kind of insulating core such as expanded plastics, cork, wood and the like. A honeycomb section has also been used, however, this more for structural support than insulation. Primarily in recent years, cork and wood have been replaced by the expanded plastics which function quite satisfactorily because they are rigid and self-supporting, as well as being good insulators. In certain situations, however, expanded plastics may form fire hazards as is the case in oven walls.

In such situations it is more desirable to use a fire retardant or fire suppressing material which is also a good insulator. Fiberglass is one such material; however, it suffers from the disadvantage that it is very soft and not structurally sound. It will not support and retain the spaced skins or panel walls in their properly spaced position. Therefore, unless the skin itself is to be made stiffer (and necessarily more expensive), so that the edges, when joined, will be structurally sound, some other type of stiffening means is required particularly along the edge where the two panels are joined.

SUMMARY OF THE PRESENT INVENTION

The present invention is directed, in general, to a simple, economical, and satisfactory approach to the problem of stiffening prefabricated panels having fiberglass cores without using a skin of significantly thicker dimensions. Further, no expensive extrusions or other special stiffening members are necessary in the approach of the present invention.

Each of the aforementioned facing sheets includes a central web section, a side wall extending inwardly from the each of the side edges of the web section a distance such that the cumulative length of the side walls is substantially equal to the panel thickness. A first flange extends inwardly from the free edge of one of the side walls toward the core and a second flange extends outwardly from the free edge of the other of the side walls away from the core. The flanges are formed generally parallel to the central web and are substantially equal in width, so that when one facing sheet is inverted and placed atop the other, the first flange of one sheet is substantially coextensive with the second flange of the other sheet. In joining the two facing sheets to form a panel, a rectangular or square structural support member of a cross-sectional size substantially equal to the space formed by the inwardly turned flange is positioned within each of such spaces. A fiberglass core is inserted between the central web section of the two spacer sheets, and a strip of heat non-conductive material is placed between the adjoining side flanges to minimize transfer of heat from one facing sheet to the other.

In assembling two panels, so prefabricated, the edges are overlapped in abutting relationship with a slight spacing therebetween. An elongated force absorbing rod is inserted between the adjacent abutting walls of the two panels, on both the inside and outside, and coated with a release agent (unless the rod is formed of polyethylene). A silicon or other elastomeric adhesive compound is then applied to the space between the adjacent panel walls outwardly of the force absorbing rod to hold the panels together. Such an elastomeric joint allows an improved expansion and contraction characteristic. Further, the release agent prevents the silicon cement from adhering to the force absorbing rod so that the silicon is not sheared or otherwise affected by the expansion and contraction of the rod.

It is therefore an object of the present invention to provide a prefabricated building panel for modular construction incorporating a pair of facing sheets having a fiberglass core therebetween.

It is another object of the present invention to provide a building panel of the type described in which a rectangular structural supporting member is provided along the side edges of each building panel to prevent collapse thereof.

Another object of the present invention is to provide a modular building panel of the type described in which heat transfer is minimized from one skin to the other.

It is still a further object of the present invention to provide a fiberglass core, modular, prefabricated building panel which requires no significant edge work and in which no metal extends through the panel from one skin to the other to minimize the heat conducting path from one skin to the other.

It is still a further object of the present invention to provide a modular building panel of the type described in which the outer and inner facing sheets thereof are identical in shape and of extremely simple configuration, and in which the facing sheets of one wall may be formed of a different material and the facing sheets of the other wall, even though the shape and configuration is identical.

Other objects and a fuller understanding of the invention will become apparent from a review of the following detailed description of a preferred embodiment read in conjunction with the accompanying drawings in which.

DETAILED DESCRIPTION OF A PREFERRED EMBODIMENT

Figure 1:
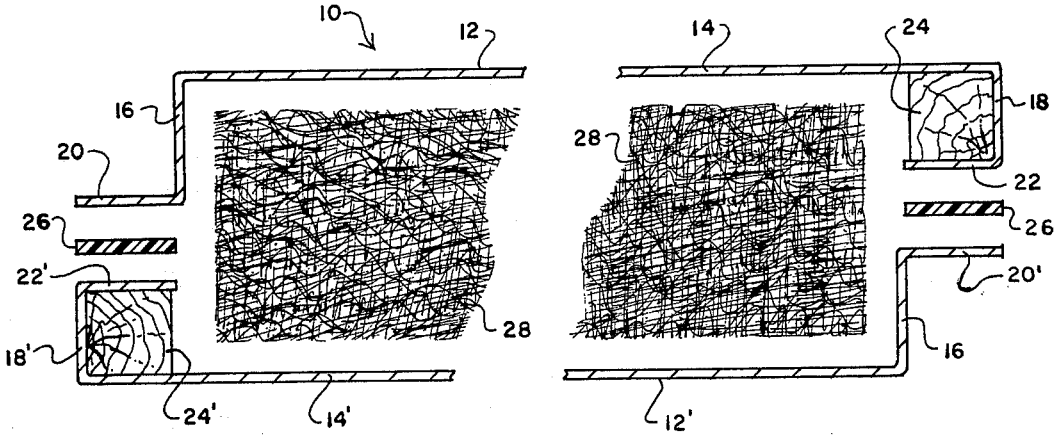
FIG. 1 is an exploded sectional view of a single modular panel according to the present invention.

Turning now the the drawings the present invention is directed to an improved modular panel construction which, as one feature thereof, includes a unique, simplified, economical construction of a panel 10. Further, a plurality of panels 10 are joined together in a unique, improved way as will be described hereinbelow.

Panel 10 (FIG. 1) includes a pair of identically formed facing sheets 12,12' joined along opposite side edges thereof and having included therein a fiberglass core 28 which extends between the two central web surfaces 14,14' of the two facing sheets.

Facing sheet 12 is identical to facing sheet 12', and therefore only facing sheet 12 will be described hereinbelow, it being understood that the elements of facing sheet 12' are the same and indicated on the drawing by a corresponding number with a ' notation thereafter. The central web section 14 may be of any height depending on the height of the walls to be formed. As far as the width is concerned any good modular width may be used; however, the width is preferably approximately 24 inches. A pair of side walls 16,18 extend inwardly from each side edge of said web section 14. Wall 18 terminates at a point slightly less than one-half of the distance between the planar surfaces while the height of side wall 16 is slightly greater than one-half the distance between the opposed web sections. The sum of the height of walls 16 and 18 is substantially equal to the web separation. Side edges 16 and 18 preferably extend completely along the corresponding side edges of central planar or web section 14.

A first flange 22 extends inwardly from the free edge of side wall 18 toward core member 28, and a second flange 20 extends outwardly from the free edge of the other side wall 16 away from the core member 28. Both first and second flanges 20,22 are substantially parallel to said central web section 14, and are preferably substantially the same width and substantially in width equal to the height of the side wall 18, so that a generally square space is thereby formed between flange 22, side wall 18, and a corresponding portion of web section 14. Also, flange 20 is approximately the same length as flange 22 so that when one sheet is inverted and placed over the other the two adjoining flanges are substantially coextensive.

A structural support member 24 which may either be a square or rectangular wooden, elongated member or a similarly shaped member of any other suitable material is placed in and substantially fills the area formed by flange 22, side wall 18, and the side edge portion of central web 14. Although wood is preferred because of its inherent ability to receive most types of fasteners, other materials could also be used. A pair of facing sheets 12,12' are placed together as illustrated in FIG. 1 with one of the sheets 12 being inverted and placed atop the other facing sheet 12', each of which have the structural support members 24,24' inserted at the proper place and with core 28 placed between the two facing sheets.

A strip 26 of non-conducting material, such as asbestos or pressure sensitive tapes of various types, or other heat non-conducting material is inserted between flange 20 of facing sheet 12 and flange 22' of facing sheet 12'. Similarly another strip 26 is placed between flange 22 of facing sheet 12 and flange 20' of facing sheet 12'. The assembly is then secured by the insertion of staples, nails, screws, or other fasteners 29 through flange 20, sheet 26, flange 22' and into the structural support member 24'.

It should be recognized that the fiberglass core 28 is so dimensioned as to be of a thickness substantially equal to the distance between central webs 14,14', and of a width such as to extend between one side wall 16 and the corresponding side wall 16' of the other facing sheet in the assembled position. That is to say, generally the fiberglass core does not extend into the area or space formed by flange 22, side wall 18, and the corresponding portion of central web 14, although in certain situations such might occur. Also, planar sheets 12,12' may be formed of any suitable material such as embossed aluminum, galvanized sheet metal, or any other suitable material. Also, in the same panel if desired, the outside may be formed of one material while the inside is formed of different material. For example, the outside may be embossed aluminum while the inside is galvanized sheet metal. In such case, the heat barrier 26 should be of a dielectric material, as well as being heat non-conducting.

Figure 2:
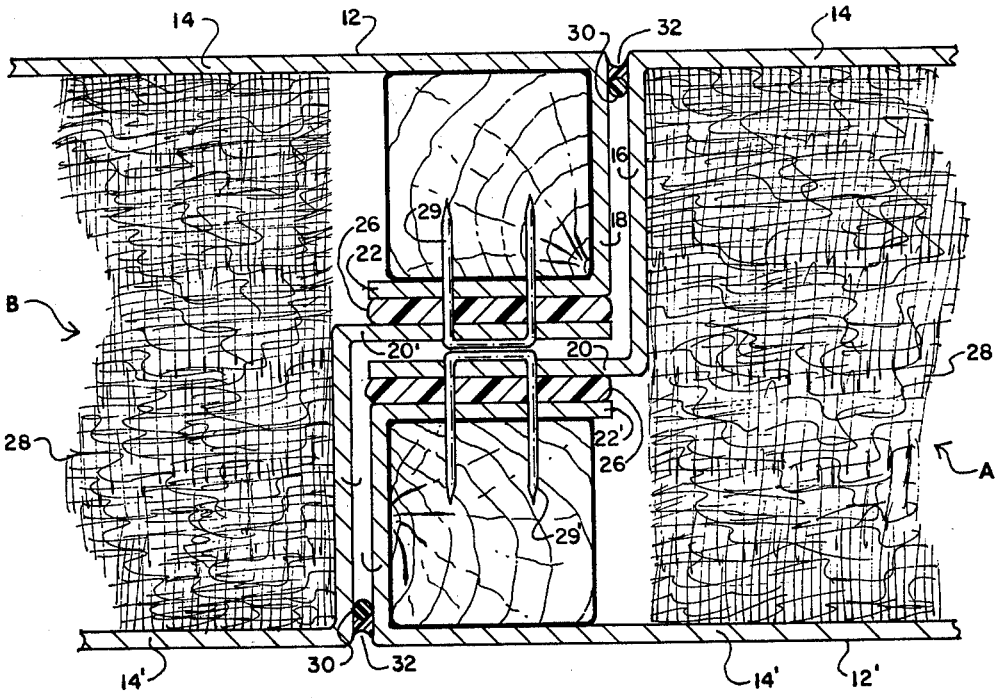
FIG. 2 is an enlarged sectional view showing portions of adjacent panels and the manner in which they are joined.

Turning now to FIG. 2 there is illustrated the technique in accordance with the present invention by which a pair of adjacent panels are assembled and secured together. First of all, two panels A,B fabricated in accordance with the procedure illustrated in FIG. 1 and described hereinabove, are positioned in side by side relationship with the side edges thereof overlapping as illustrated in FIG. 2. A force absorbing rod 30 is then emplaced between side wall 16 of panel A and side wall 18 of panel B. The rod 30 is of a diameter slightly greater than the desired spacing between the two panels, extends the length of the panels and is coated with a suitable release agent which is conventionally available. A silicon base adhesive or cementitious material 32 which is then applied to the U-shaped area formed between the aforementioned side walls and exteriorly of the rod 30 and allowed to set up to form an elastomeric adhesive joint or connection therebetween, much the same as mortar joint, except with silicon. A similar joint is formed on the opposite side of the panel connection between side wall 16' of panel B and side wall 18' of panel A.

Where polyethylene is used as a material for rod 30, the release agent is not necessary. Such a joint allows expansion of the panels A,B and the release agent (where used) prevents adherence of the rod to the silicon adhesive. Otherwise, if the rod became adhered to the silicon, the contraction and expansion of the rod would cause shearing of the silicon joint.

As stated hereinabove, the forece absorbing rod and silicon base adhesive joint described hereinabove is known in brick working; however, to the knowledge of the inventor, it has not been heretofore used in the connecting of modular sheet metal panels.

While a preferred embodiment has been described in detail hereinabove, it is apparent that various changes and modifications might be made to the specific structure recited without departing from the scope of the invention, which is set forth in the claims below.

What is claimed is:

1. A prefabricated building panel comprising:

(a) a pair of identically formed facing sheets joined along opposite side edges thereof and including a fiberglass core between the central planar surfaces of said two facing sheets;

(b) each of said facing sheets including:

(i) a central web section;

(ii) a side wall extending inwardly from each side edge of said web section;

(iii) a first flange extending laterally from the free edge of one of said side walls in a direction toward said core, and a second flange extending laterally from the free edge of the other of said side walls in a direction away from said core, said first and second flanges being substantially parallel to said central web section;

(c) said pair of facing sheets joined together with the first flange of each sheet being joined to the second flange of the other sheet;

(d) a structural support member of a size substantially equal to the space formed by said first flange, adjoining side wall, and opposite portion of said web, and positioned within said space to provide structural support along the edges of said panel;

(e) a flat strip of heat non-conducting material positioned between the adjoining flanges of said pair of facing sheets to minimize transfer of heat from one facing sheet to the other; and (f) a plurality of fasteners extending through adjacent flanges of said facing sheets, through said strip of non-conducting material, and into said structural support member.

2. The building panel according to claim 1 wherein said one side wall is of a height less than the other of said side walls, and the cumulative heights of both of said side walls is substantially equal to the separation between the web section of said facing sheets.

3. The building panel according to claim 1 wherein said structural support member includes a wooden, rectangular member extending along substantially the entire edge of each side of the panel.

4. The building panel according to claim 1 wherein the material from which said strip is formed is also a dielectric.

5. A building construction comprising:

(I) a plurality of prefabricated, modular panels, each panel including:

(a) a pair of identically formed facing sheets joined along opposite side edges thereof and including a fiberglass core between the central planar surfaces of said two facing sheets;

(b) each of said facing sheets including:

(i) a central web section;

(ii) a side wall extending inwardly from each side edge of said web section;

(iii) a first flange extending laterally from the free edge of one of said side walls in a direction toward said core, and a second flange extending laterally from the free edge of the other of said side walls in a direction away from said core, said first and second flanges being substantially parallel to said central web section;

(c) said pair of facing sheets joined together with the first flange of each sheet being joined to the second flange of the other sheet;

(d) a structural support member of a size substantially equal to the space formed by said first flange, adjoining side wall, and opposite portion of said web, and positioned within said space to provide structural support along the edges of said panel;

(e) a strip of heat non-conducting material positioned between the adjoining flanges of said pair of facing sheets to minimize transfer of heat from one facing sheet to the other; and (f) a plurality of fasteners extending through adjacent flanges of said facing sheets, through said strip of non-conducting material, and into said structural support member;

(II) said plurality of panels being positioned in side-by-side relationship with the joined flanges on one side of one panel overlapping the joined flanges along the corresponding side of the adjacent panel forming a panel interface, means for joining said adjacent panels together at said interface including:

(a) a force absorbing rod formed of an elastomeric material and positioned in the interface between corresponding side walls of said adjacent panels, said rod extending the length thereof along a line spaced inwardly from the exterior surface of the two panels, said rod being of a diameter slightly greater than the spacing of the interspace between said two panels;

(b) a silicon base, cementitious material being applied into the interspece between the two panels and between said rod and said exterior surface of the two panels to substantially fill said interspece, whereby said panels are attached together with a resulting provision being made for expansion and contraction of the panels without shearing of the cementitious material; and (c) means between said cementitious material and said rod for preventing adherence of one to the other.

6. The building construction according to claim 5 wherein said force absorbing rod is formed of polyethylene, the surface of which is said means for preventing adherence of the rod to the cementitious material.

* * * * *